US007654485B2

(12) United States Patent
Rossel et al.

(10) Patent No.: US 7,654,485 B2
(45) Date of Patent: Feb. 2, 2010

(54) BANKNOTE STORE

(75) Inventors: Didier Rossel, Grand-Lancy (CH); Christian Voser, Vessy (CH)

(73) Assignee: MEI, Inc., West Chester, PA (US)

( * ) Notice: Subject to any disclaimer, the term of this patent is extended or adjusted under 35 U.S.C. 154(b) by 238 days.

(21) Appl. No.: 11/538,999

(22) Filed: Oct. 5, 2006

(65) Prior Publication Data

US 2007/0221776 A1 Sep. 27, 2007

(30) Foreign Application Priority Data

Oct. 6, 2005 (EP) ..... 05256261

(51) Int. Cl.
*B65H 39/14* (2006.01)

(52) U.S. Cl. ..... 242/528; 271/3.01; 271/216

(58) Field of Classification Search ..... 242/528, 242/412.3, 413.2; 271/3.01, 216
See application file for complete search history.

(56) References Cited

U.S. PATENT DOCUMENTS

| | | | | |
|---|---|---|---|---|
| 2,996,264 | A | 8/1961 | Bygdnes | |
| 3,252,669 | A | 5/1966 | Geri | |
| 3,528,627 | A | 9/1970 | Sindlinger | |
| 3,716,205 | A | 2/1973 | Geuder | |
| 4,145,016 | A | 3/1979 | Wiig | |
| 4,871,125 | A * | 10/1989 | Haueter | 242/528 |
| 5,622,027 | A * | 4/1997 | Staub et al. | 53/118 |
| 6,164,585 | A * | 12/2000 | Lutz | 242/528 |
| 6,669,136 | B2 * | 12/2003 | Niioka et al. | 242/528 |
| 6,715,753 | B1 * | 4/2004 | Conca et al. | 271/216 |
| 6,969,064 | B2 * | 11/2005 | Ichikawa et al. | 271/216 |
| 7,424,942 | B2 * | 9/2008 | Voser | 194/206 |
| 2002/0060413 | A1 | 5/2002 | Sato et al. | |
| 2002/0113160 | A1 | 8/2002 | Niioka et al. | |

FOREIGN PATENT DOCUMENTS

| | | |
|---|---|---|
| EP | 0 290 731 A2 | 11/1988 |
| EP | 1 321 409 A1 | 6/2003 |
| FR | 1 109 055 A | 1/1956 |
| JP | 06-206646 | 7/1994 |

* cited by examiner

*Primary Examiner*—Sang Kim
(74) *Attorney, Agent, or Firm*—Fish & Richardson P.C.

(57) ABSTRACT

A method of controlling a banknote store comprising at least one winding means and at least one elongate support means which can be wound and/or unwound from the winding means for storing and/or transporting a banknote, comprises determining the radius or diameter of a spool comprising at least the winding means using the degree of rotation of the winding means and the corresponding linear amount of movement of the elongate support means.

17 Claims, 2 Drawing Sheets

BANKNOTE STORE

BACKGROUND

The invention relates to the storage of banknotes or other sheets of value, which are herein referred to simply as banknotes.

It is known hereto to provide a banknote store comprising first and second drums with a strip wound onto both drums and arranged to support banknotes disposed in succession between windings of the strip on the first drum. The strip is wound from the first drum to the second drum to expose successive supported banknotes for removal and is wound from the second drum to the first drum to enable banknotes to be deposited successively on the first drum. The second drum is driven to rotate to wind the strip from the first to the second drum while the first drum may be driven to follow the second drum. In the opposite direction, the first drum is driven to rotate to wind the strip from the second to the first drum while the second drum may be driven to follow the first drum. It is known for the first and the second drums to be fixed for rotation relative to respective shafts which are themselves driven by one or more motors.

When the strip is wound from one to the other drum, it important for the strip to be held firmly between the two drums at all times. As banknotes are stored in discrete locations relative to the strip, movement of the strip would mean that the control arrangement of the banknote store would not be able to locate the exact position of individual banknotes.

During operation, as the number of windings decreases on one drum, the length of strip unwound therefrom also decreases, provided the rotational speed of the drum remains constant. The same is true in reverse. That is, as the number of windings on the other drum increases, the length of strip being wound onto the other drum increases, again, provided the rotational speed of the drum remains constant. This is because the length of strip wound onto or unwound from a drum is dependent on the circumference of the outer winding on the drum. In the prior art, the strip may be held firmly between the drums, by winding the strip onto one drum by rotating that drum, whilst providing some resistance to rotation of the other drum, from which the strip is being unwound. This arrangement enables the strip to be held firmly only when the drums are rotating but may not when the drums are stationary.

In an alternative prior art arrangement, the drums are rotated at varying speeds. In this way, as the strip is unwound from one drum, the drum may be rotated gradually more quickly, because the length of strip being unwound from it per revolution gradually decreases. The reverse is true for the other drum, which may be rotated gradually more slowly as the length of strip being wound onto it per revolution gradually increases. The continuous adjustment of the rotational speeds of the drums requires relatively complicated and expensive arrangements and control of the motor or motors driving the shafts.

It is known that as the diameter of the banknote store increases, the stability of the store decreases, and it may interfere with other components of the apparatus. In the prior art, this problem was solved by limiting the number of banknotes that could be stored.

U.S. Pat. No. 6,715,753 discloses a method directed to this problem which involves a belt tightening operation to increase the storage capacity. One feature of the method is determination of the radius of a spool on a driven reel, which is used to ensure that the storage belt has the same speed at all times. The radius is determined as the ratio of velocity of the belt from a belt speed measuring sensor and the angular velocity from a stepping motor for the driven reel.

SUMMARY

Aspects of the invention are set out in the accompanying claims.

As a result of aspects of the invention, it is possible to determine the diameter of the wound spools to ensure that banknotes are properly positioned on the tape and that the diameter of the wound tape does not get too large (including the banknote thicknesses) and interfere with other components or jam. It is also possible to sense the end of the tape. It is also possible to monitor a banknote store, for example, for theft. It is also possible to estimate the remaining capacity of the store.

BRIEF DESCRIPTION OF THE DRAWINS

In order that the present invention may be well understood, an embodiment thereof, which is given by way of example only, will now be described with reference to the accompanying drawings, in which.

DETAILED DESCRIPTION

Figure 1:
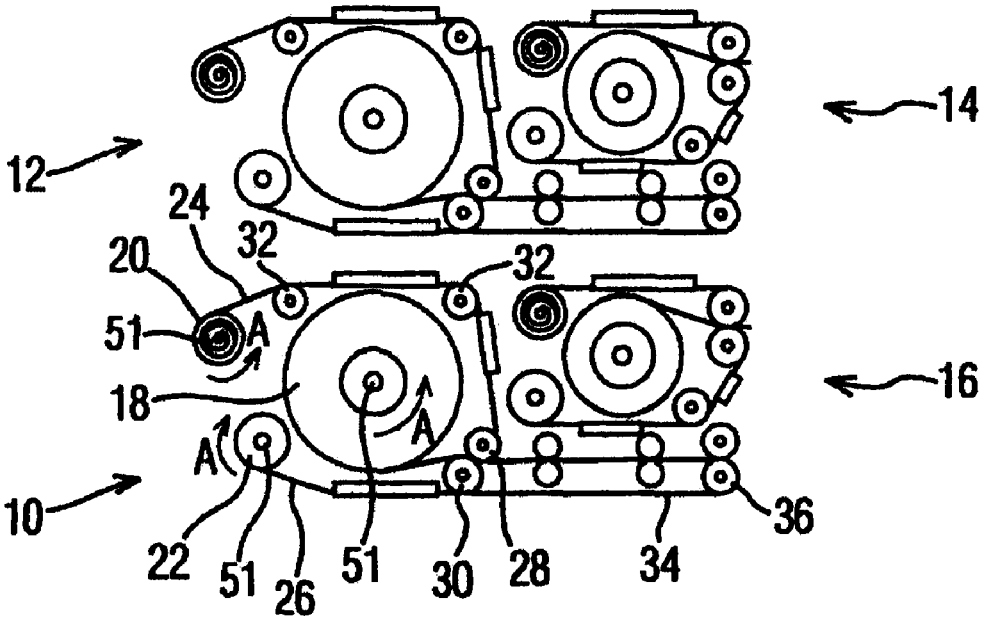
FIG. 1 is a general side view of a set of four banknote stores.

Referring to FIG. 1, four banknote stores 10, 12, 14, 16 are shown. Such banknote stores may make up component features of a banknote receiving and dispensing machine. Since the stores are very similar, specific reference herein will be made only to store 10.

Store 10 comprises a first, or storage, winding means and two second, or supply, winding means. The first winding means may take the form of a storage drum 18 and the second winding means may take the form of supply drums 20, 22. Other types of winding means may be used as appropriate. The storage drum has wound around it a pair of strips 24, 26 which extend away from the storage drum to rollers 28, 30. The strips then separate, with one strip extending around roller 28 to supply drum 20, and the other strip 26 extending around roller 30 to supply drum 22. Between roller 28 and supply drum 20, strip 24 is guided by additional rollers 32. The strips have marks 62 (shown generically in FIG. 3) spaced at regular intervals on one or both sides for indicating distance. The strips are one example of elongate support members but other examples may be used instead.

If the storage drum 18 and the supply drums 20, 22 rotate in the directions indicated by the arrows A, the strips 24, 26 are unwound from the storage drum and onto respective supply drums 20, 22. The storage drum 18 and the supply drums 20, 22 can alternatively rotate in the opposite directions so that the strips are unwound from the supply drums onto the storage drum.

Banknotes (60, see FIG. 2) can be fed between the strips 24, 26 as they come together at rollers 28, 30, when the strips are being wound onto the storage drum 18. Thus, individual banknotes can be stored in a spiral arrangement on the storage drum, in successive positions between strips 24, 26. In the view shown in FIG. 1, an endless belt or strip 34 and series of rollers 36 can be used to guide the banknote from one position relative to the banknote store 10 to be taken up between strips 24, 26. Thus, assuming that the strips 24, 26 are being unwound from the storage drum (drums rotated in direction A), any banknotes held thereby will be delivered to belt 34 to be guided to an appropriate position, for instance in a banknote receiving and dispensing machine. Conversely, a banknote introduced to such a machine may be guided to a position between rollers 28, 30 whilst strips 24, 26 are being wound onto storage drum 18 (drums rotated in opposite direction to A). The banknote becomes gripped between the strips 24, 26 as they converge at rollers 28, 30, the banknote then being transported to the storage drum.

Figure 2:
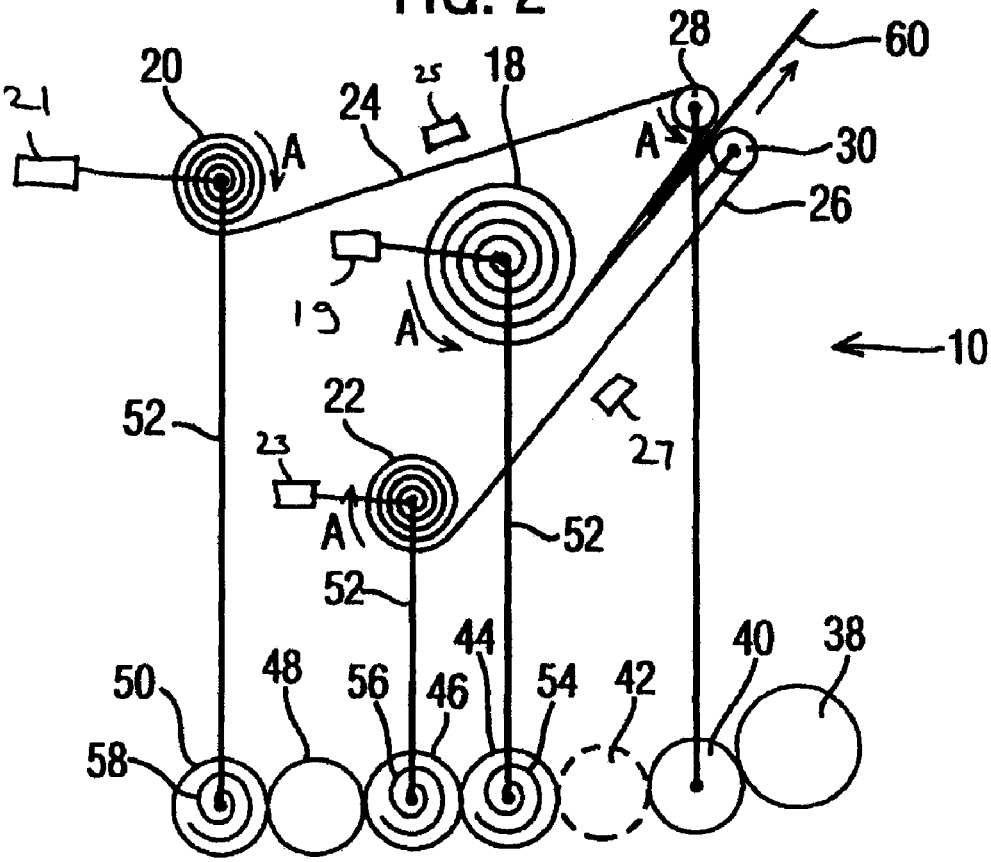
FIG. 2 is a schematic view illustrating the principle of operation of a banknote store of an embodiment of the invention.

Referring to FIG. 2, a motor 38 is used for driving, via a gear 40, the shafts of the rollers 28 and 30 to transport the strips 24, 26 at a constant speed in either of two opposite directions.

Gears 44, 46 and 50 are coupled to shafts 51 (see FIG. 1) of storage drum 18 and supply drums 22 and 20, respectively, as shown schematically by lines 52 in FIG. 2. These gears interengage such that they rotate together, in this case by interengaging storage drum gear 44 with first supply drum gear 46, and first supply drum gear 46 with second supply drum gear 50 via an idler gear 48. (In FIG. 2, the arrangement differs slightly from FIG. 1, in that the supply drums rotate in the same direction, so the idler gear 48 is provided between gears 46 and 50 to achieve this.)

Biasing means in the form of spiral or torsional springs 54, 56, 58 connect the shafts to the respective gears 44, 46, 50. The springs allow biased relative rotational movement between each drum and its gear. In this way, strips 24, 26 wound around the drums can be held tightly at all times. The springs are biased in directions which tend to cause winding of the strips onto the respective drums, which also keeps the strips under tension. The use of springs or other biasing means provides a relatively compact and low cost solution. A similar effect can be achieved by alternatively providing the springs between the shafts and the drums, in which case, if the shafts extend through the drums the springs may be provided between the shafts and a radially inwardly facing surface of the respective drum.

Angular rotation sensors 19, 21, and 23 are connected to the shafts 18, and 22 of the storage drum 18 and the supply drums 20, 22 respectively. Linear motion sensors in the form of sensors which sense marks on the strips 24, 26 are arranged alongside the paths of the strips 24, 26 facing the marks on the strips respectively. In this embodiment, the linear motion sensors include LEDs and light sensors which sense light reflected from the strips, thereby sensing the marks according to the corresponding variation in reflected light. Other types of arrangement for sensing marks on strips may be used. Indeed other ways of determining linear motion may be used such as magnetic sensors. In a preferred embodiment, a coding wheel is attached to a roller, such as one of the guide rollers 36, and associated with a sensor for sensing marks on the coding wheel. The rotation of the coding wheel can then be used to determine the linear translation of the belt. The angular rotation sensors and linear motion sensors are connected to a control device (not shown).

Figure 3:
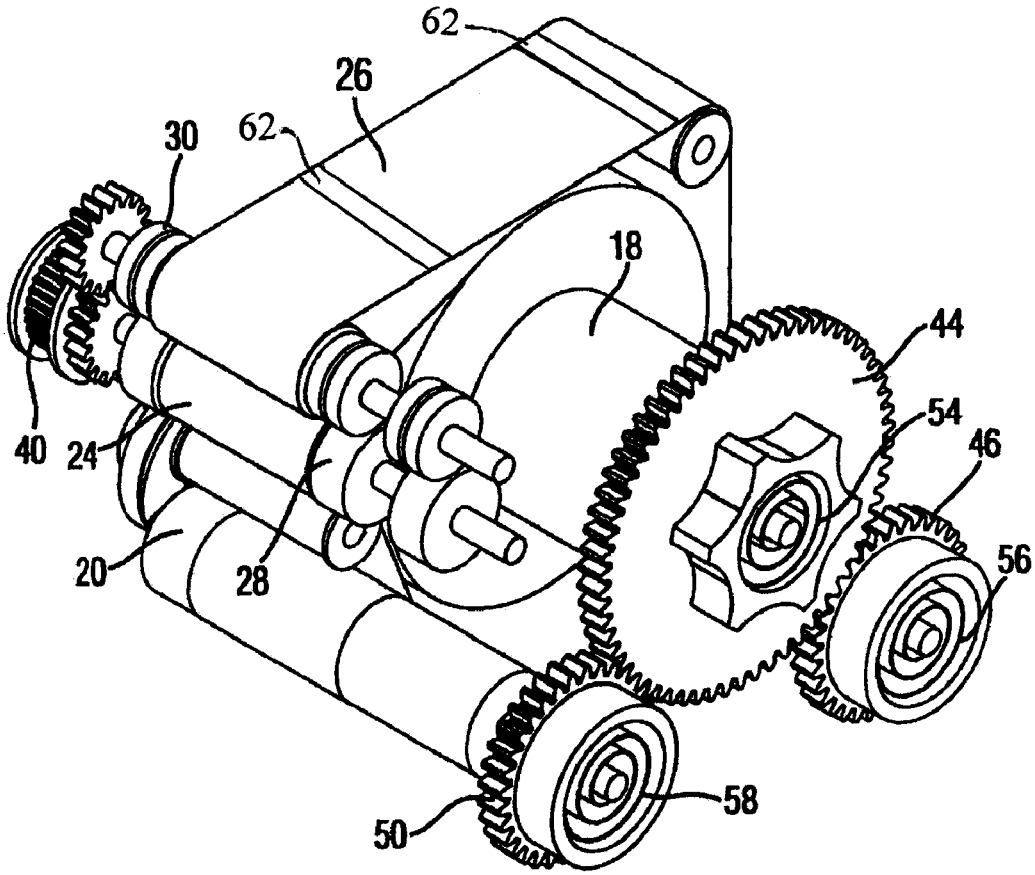
FIG. 3 shows a slightly modified version of one of the banknote stores of FIG. 1.

A practical arrangement is shown in FIG. 3, in which like reference numbers represent like integers. The store of FIG. 3 is similar to those of FIGS. 1 and 2 except for a re-arrangement of the relative positions of the drums, rollers and gears, and the angular rotation sensors 19, 21, 23 and the linear motion sensors 25, 27 of FIG. 2 are not shown. In this case, the gear 44 for the drum 18 engages each of the gears 46 and 50 for the supply drums 22 and 20, respectively.

The banknote store operates as follows.

The rollers 28 and 30 are driven at a constant speed, which determines the speed at which the strips 24, 26 travel. The peripheral speeds of the drums will match the speed at which the tape is fed to or from the drums. Generally speaking, this means that the drums will rotate at a different speed from their associated gears, whose relative speeds will be governed by the gear ratios. This is permitted by the contraction and expansion of the respective springs 54, 56 and 58.

In the preferred embodiment, the gear ratios are set so that, for each drum, when the drum is halfway between its empty and full state, the rotational speed of the driving gear matches the rotational speed of the drum, as determined by the speed of movement of the strips 24, 26. Appropriate gear ratios can be determined from the diameters of the half-wound drums.

In such an arrangement, the spring for each drum has its minimum tension when the drum is half full, although this tension is still significant because the spring is pre-loaded during assembly.

If the drum is less than half full, the periphery will be relatively small so that the drum should rotate faster than the gear. Thus, if the strip is being unwound, the speed of the strip rotates the drum relative to its associated gear, resulting in tensioning of the spring. On the other hand, if the strip is being wound on to the drum, the relatively fast feeding of the strip to the drum means that the spring is allowed to relax, causing an increased peripheral speed of the drum.

Conversely, if the drum is more than half full, the diameter of the drum including the strip wound thereon will be relatively large, and therefore the drum should rotate relatively slowly. The tension in the strip will slow down the drum relative to the driving gear, causing the spring to become gradually tighter, if the strip is being wound on the drum. If it is being unwound, the spring is able to relax, as the drum rotates relative to its associated gear, resulting in the drum rotating slower than the gear.

The result is that, for each drum, as the drum rotates to permit the strip to be unwound from the full state to the empty state, the tension in the spring first decreases to a minimum and then increases again. Similarly, when winding the strip on to the drum, the tension in the spring decreases to a minimum before rising again.

This arrangement has significant benefits. First, it means that the range of tension in each spring is relatively small, thus making it easier to select a suitable spring and to manufacture the assembly, and reducing the range of tensions applied to the strips. Second, the changes in tension within the springs for the supply drums 20, 22 occur at substantially the same time as corresponding changes in tension in the spring for the main drum 18. This balances the tension on both sides of the roller 28, thus reducing the risks of the strips 24, 26 slipping. Preferably, the assembly is designed so that the tensions produced by the springs change in synchronism in a balanced manner even though this may mean that the minimum tension does not necessarily occur when the respective drum is exactly half full.

The linear motion sensors and the angular rotation sensors are used to determine the diameter or radius of one or more of the storage drum 18 and supply drums 20, 22. The following will refer to the diameter of the drums, but it is to be understood that the same applies to radius (diameter=twice radius). In the case of the supply drums, the calculated diameter is of the spool including the known diameter of the shaft, together with the strips wound around the shaft at the time. At the end of the strip, the calculated diameter may be of the shaft alone.

Similarly, the diameter of the storage drum may be of the shaft alone, or the shaft together with wound strips, or the shaft together with wound strips and banknotes stored on the storage drum.

The following procedure refers to supply drum 20, but the same procedure may be applied to any of supply drums 20, 22 and storage drums.

Between first and second known times, the amount of rotation of supply drum 20 is detected by angular rotation sensor 21 and the corresponding amount of linear movement of belt 24 is detected by linear motion sensor 25. The detected rotation amount θ and the linear movement amount l are processed in the control device.

More specifically, the corresponding diameter d of the supply drum is calculated using the equation:

$$l=r\theta, \text{ where } 2r=d \text{ and } \theta \text{ is measured in radians}$$

In other words, $d=2l/\theta$.

This diameter measurement may be used as an approximation irrespective of whether the drum is winding the strips on or off the drum.

In the case of winding the strip onto the supply drum, the diameter measurement should be a good approximation of the wound supply drum. In the case of unwinding the strip from the supply drum, it may be appropriate to subtract the thickness of the strip from the diameter measurement to get a more accurate calculation of the diameter of the supply drum after the unwinding.

Similarly, in the case of the storage drum, the diameter measurement as calculated above should give a good approximation of the storage drum after the strips and possibly banknotes are wound on. On the other hand, the diameter calculation may take into account the thickness of the strips and possibly also banknotes wound off the storage drum for a more accurate measurement.

In an alternative arrangement, a drum is moved by a predetermined amount and the corresponding amount of linear movement of the corresponding strip is measured. The resulting measurements for θ and l are then used to calculate the corresponding diameter of the drum as described above.

For example, the stepper motor 38 moves a drum by a predetermined amount, such as $1/12^{th}$ of a full rotation, and the corresponding amount of movement of the corresponding strip is measured using the corresponding linear sensor.

Similarly, in another alternative arrangement, a strip is moved by a predetermined amount, and the corresponding amount of rotation by a drum required is measured. The resulting measurements for θ and l are then used to calculate the corresponding diameter of the drum as described above.

For example, the tape is moved by a fixed amount, such as the fixed amount required to store a new bill on the storage drum 18, and the amount of rotation required to achieve this is measured.

The resulting diameters derived as set out above may be used in various ways. The uses may alternatively involve other methods of measuring diameters, but the method described above is preferred.

For example, one or more diameters may be compared with one or more thresholds. Two or more diameters may be combined, and similarly compared with one or more thresholds.

For example, in the case of the storage drum 18, the diameter of the drum 18 may be compared with a threshold so that no more banknotes are stored when the diameter reaches a certain level. This can prevent jamming which might otherwise occur when the diameters becomes too large.

The minimum diameters of the drums are determined by the diameter of the respective shafts. Thus, thresholds based on the minimum diameters may be used to indicate the end of the strips.

Especially in the case of a supply drum, the maximum diameter is determined by the length of the tape. Thus, thresholds based on the maximum diameter may also be used to indicate the end of the tape.

This means that a separate sensor for detecting the end of the strips is not required.

It is possible that there may be a condition in the apparatus whereby two or more drums in the apparatus may interfere with each other, for example, depending on banknote storage and banknote thickness. To avoid such a situation, it might be necessary, for example, to space the drums sufficiently far apart so that, whatever the thickness of banknotes stored on the drum and however many banknotes are stored, the drums cannot interfere with other, or, for example, to put a predetermined limit on the number of banknotes stored. As a result, the banknote store might be large or limited in the number of banknotes that can be stored. To overcome these problems, using an embodiment of the invention, a combination of diameters of two or more drums in the apparatus may be used and compared with thresholds, for example, preventing additional storage of banknotes if the combination exceeds a threshold. As a result, the drums can be placed relatively close to each other, reducing the size of the banknote store, and provide dynamic control of storage.

Diameter measurements may be used, for example, to detect theft of banknotes from a store. In an embodiment of the invention, the diameter of the store is measured at a first time, such as when the apparatus containing the store is powered down, and then the diameter of the store is measured again when the apparatus is powered up. The two diameters are then compared, for example, by comparing the difference with a threshold. If the comparison indicates that the diameters are difference, or different by more than a given amount, then this may indicate that one or more banknotes have been removed while the apparatus was powered down. The diameter measurements may form part of the powering down/up routines, for example, by moving the strip or the drum by a corresponding amount and determining the corresponding movement of the drum or strip.

Diameter measurements may also be used, for example, to estimate the remaining capacity of the store. This is especially useful if the store is used as an escrow (temporary store for banknotes inserted in a transaction, which may subsequently be returned to the user, or retained in a store). For example, if the current diameter of the store and the total length of the belt are known, then the approximate remaining capacity, or turns on the store, can be calculated. This can be combined with known information about approximate lengths of banknotes to estimate the remaining capacity, or the number of further banknotes that can be stored.

In operation, the banknote store may be initialised after manufacture by running the strips 24, 26 from one drum to another, such as from the storage drum to the supply drums. This could be used to determine the length of the tape, using the linear sensors 25, 27, and to get the tape to the start position. The end of the tapes may be identified as discussed above.

The above techniques may be applied to other winding means similar as storage and supply drums, and may be used in other types of banknote stores.

The above techniques may be also be applied using angular velocity or angular acceleration sensors, and linear velocity or linear acceleration sensors etc, from which corresponding angular rotation θ and linear movement l can be calculated by integration. However, this is less desirable because such sensors require more space and cost more, and also addition processing is required.

Alternatives to the above arrangement are possible. For example, the gear ratios could be selected so that the speed of rotation of the drum matches that of the associated gear when the drum is fully wound (or fully unwound), in which case the tension in the spring will monotonically change as the drum is fully unwound (or wound).

One advantage of the above-described arrangement is that the speed of movement of the strips 24, 26 remains constant throughout the operation, so that the operation of the storage apparatus can be synchronised to the rest of the host machine in which it is installed, and, if desired, the same motor can be used to drive both the storage apparatus and other parts of the machine. If desired, additional means may be provided to maintain this constant, predictable speed of movement, by avoiding slippage at the rollers 28, 30 or by detecting such slippage and taking corrective action.

Although FIG. 2 shows springs associated with the storage drum 18 and the supply drums 20, 22, it would be possible to use springs associated with the supply drums only or the storage drum only, although in such arrangements a constant speed of movement of the strips 24, 26 may be more difficult to achieve. Where springs are associated with only the supply drums they would need to be sufficiently expansive to compensate for the change in speed of both the supply drums and the storage drum. It would be possible to associate a single spring with the storage drum only, if the supply drums behaved symmetrically with each other (for example, if coupled using a differential gear). Otherwise, the strips would be wound onto and unwound from the supply drums unevenly.

Reference has been made to spiral or torsional springs but other types of biasing means could be used, as required. The purpose of the springs is to allow relative rotational movement between the drums and their respective gears or coupling means whilst biasing the drums in a direction to cause the strips to be held tightly.

In FIGS. 1 and 2, two strips 24, 26 are used but it would be possible to use a single strip which would be wound around a storage drum and a single supply drum. Banknotes would then be stored between windings on the storage drum rather than between separate strips on the storage drum as shown. Where a single strip is used, it would be possible to incorporate biasing means with either the storage drum, supply drum or preferably both.

Figure 4:
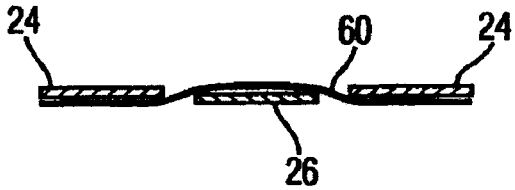
FIG. 4 is a cross-sectional view of modified strips of a banknote store.

In a modification of the illustrated embodiment shown in FIG. 4, strips 24, 26 do not overlap. Two strips 24 are wound around the storage drum and a first supply drum. The other strip 26 is wound around the storage drum and a second supply drum. When the strips 24, 24, 26 are wound around the storage drum, they do not overlap. The banknote 60 is supported between the strips, with strips 24, 24 on one side thereof and strip 26 on the other side thereof. This has the advantage that two windings of the modified strips have approximately the same radial thickness as a single winding of strips 24, 26 as illustrated in FIG. 4. With the reduced thickness, the amount of extension and retraction required to be performed by the biasing means is reduced, since the maximum change in thickness during operation of the storage drum for a given number of banknotes is less. This achieves a more compact design or alternatively means that more banknotes can be stored on a drum of the same approximate size, the governing factor being concerned more with the thickness of the banknotes and less so with the thickness of the strips.

The arrangements described above could be modified by supplying a positive driving force to the various drums, for example using a gear 42 shown in broken lines in FIG. 2 to transmit the rotation produced by the motor 38 to the gears 44, 46 and 50. Alternatively, a separate motor could be provided. However, it is preferred that the speeds of rotation of the drums be controlled by the rate at which the support strips 24, 26 are fed.

Instead of the gears shown schematically in FIG. 2, other arrangements, such as belts, could be used for coupling together the shafts of the various drums.

Instead of storing the banknotes on one drum only, the arrangement could enable transferring of banknotes from one drum to another.

In the specification, of course the radius can be used instead of the diameter, or derivations from the radius or diameter, with due alterations in detail, and the term diameter in the claims is intended to cover all such modifications.

What is claimed is

1. A machine-implemented method of controlling a banknote store comprising at least one winding means and at least one elongate support means which can be wound or unwound from the winding means for storing or transporting a banknote, the method comprising sensing indicia on the at least one elongate support means to determine an amount of movement of the at least one elongate support means, monitoring the radius or diameter of a spool comprising at least the winding means; comparing the radius or diameter of the spool with a threshold and determining based on the comparison whether additional banknotes can be stored in the spool.

2. The method of claim 1 further comprising using the radius or diameter of the spool to determine a preferred maximum or minimum capacity of the store.

3. The method of claim 1 comprising controlling addition or removal of banknotes based on the radius or diameter of the spool.

4. A machine-implemented method of monitoring a banknote store comprising at least one winding means and at least one elongate support means which can be wound or unwound from the winding means for storing or transporting a banknote, the method comprising sensing indicia on the at least one elongate support means to determine an amount of movement of the at least one elongate support means, determining a diameter of a spool; comparing the diameter of the spool at different times; and determining whether banknotes have been removed from the banknote store based on the comparison.

5. The method of claim 4 comprising comparing the diameter of the spool when the banknote store is powered down and powered up.

6. The method of claim 4 comprising outputting a signal if one or more banknotes have been removed.

7. The method of claim 4 wherein determining whether banknotes have been removed from the banknote store comprises calculating a difference between the diameter of the spool at the different times and comparing the difference with a threshold.

8. A machine-implemented method of estimating a capacity of a banknote store comprising at least one winding means and at least one elongate support means which can be wound or unwound from the winding means for storing or transporting a banknote, the method comprising:

sensing indicia on the at least one elongate support means to determine an amount of movement of the at least one elongate support means, determining a radius or diameter of a spool in the banknote store, and estimating a remaining capacity of the banknote store based on the radius or diameter of the spool.

9. The method of claim 8 comprising determining whether to use the store as an escrow based on the remaining capacity.

10. A banknote store comprising a spool comprising at least one winding means;

at least one elongate support means which can be wound or unwound from the winding means for storing or transporting a banknote, the elongate support means having indicia thereon, means for sensing said indicia for determining the amount of movement of the support means, and means for controlling the banknote store wherein the means is configured to determine the radius or diameter of a spool using the degree of rotation of the winding means and a corresponding linear amount of movement of the elongate support means and to estimate the remaining capacity of the banknote store from the radius or diameter of the spool.

11. The banknote store of claim 10 wherein the winding means is a storage drum for storing banknotes.

12. The banknote store of claim 10 wherein the winding means is a reel for supplying or removing the support means.

13. The banknote store of claim 10 comprising a stepper motor to rotate the winding means.

14. The banknote store of claim 10 wherein said indicia are marks.

15. The banknote store of claim 10 comprising first and second winding means mounted for rotation about respective axes on first and second shafts, wherein the elongate support means can be unwound from one of the winding means onto the other of the winding means, and vice versa, such that banknotes can be supported in succession by the support member while the support means is wound around at least one of the winding means.

16. The banknote store of claim 10 comprising an angular motion sensor to determine the angular rotation.

17. The banknote store of claim 10 comprising a linear motion sensor for determining the amount of linear movement.

* * * * *

UNITED STATES PATENT AND TRADEMARK OFFICE

CERTIFICATE OF CORRECTION

PATENT NO. : 7,654,485 B2
APPLICATION NO. : 11/538999
DATED : February 2, 2010
INVENTOR(S) : Rossel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 358 days.

Signed and Sealed this

Twenty-third Day of November, 2010

David J. Kappos

David J. Kappos
*Director of the United States Patent and Trademark Office*